US005460220A

United States Patent [19]

Coassin

[11] Patent Number: 5,460,220

[45] Date of Patent: Oct. 24, 1995

[54] METHOD OF AND MOLD FOR THE CONTINUOUS CASTING OF THIN SLABS

[75] Inventor: Giovanni Coassin, Pordenone, Italy

[73] Assignee: Danieli & C. Officine Meccaniche SpA, Buttrio, Italy

[21] Appl. No.: 126,767

[22] Filed: Sep. 27, 1993

[30] Foreign Application Priority Data

Feb. 16, 1993 [IT] Italy ..... UD93A000024

[51] Int. Cl.[6] ..... B22D 11/04; B22D 11/12

[52] U.S. Cl. ..... 164/483; 164/417; 164/418; 164/442; 164/459

[58] Field of Search ..... 164/418, 459, 164/442, 448, 483, 417

[56] References Cited

U.S. PATENT DOCUMENTS

| | | | |
|---|---|---|---|
| 3,559,720 | 2/1971 | Vogel et al. | 164/418 X |
| 3,563,298 | 2/1971 | Stauffer et al. | 164/418 X |
| 4,635,702 | 1/1987 | Kolakowski et al. | 164/418 |
| 4,926,930 | 5/1990 | Gay et al. | 164/418 X |
| 5,311,922 | 5/1994 | Streubel | 164/418 |
| 5,339,877 | 8/1994 | Marchesan et al. | 164/418 |

FOREIGN PATENT DOCUMENTS

| | | | |
|---|---|---|---|
| 0419570 | 2/1973 | European Pat. Off. . | |
| 0238844 | 9/1987 | European Pat. Off. . | |
| 2431888 | 3/1980 | France | 164/418 |
| 1220973 | 7/1966 | Germany . | |
| 2034762 | 1/1972 | Germany . | |
| 3501422 | 8/1985 | Germany . | |
| 3907351 | 9/1990 | Germany . | |
| 4138642 | 5/1993 | Germany . | |
| 2-15858 | 1/1990 | Japan | 164/418 |
| 1199805 | 7/1970 | United Kingdom . | |
| 2075150A | 11/1981 | United Kingdom . | |
| WO88/01209 | 2/1988 | WIPO . | |
| WO89/12516 | 6/1989 | WIPO . | |
| WO89/11363 | 11/1989 | WIPO . | |
| WO92/05898 | 4/1992 | WIPO . | |

*Primary Examiner*—J. Reed Batten, Jr.
*Attorney, Agent, or Firm*—Antonelli, Terry, Stout & Kraus

[57] ABSTRACT

The mold has movable sidewalls (13) to adjust the width of the slab and an enlarged casting chamber (11) extending along the length of the crystallizer of the mold (10). Located immediately downstream of the mold (10) are containing plates (24) and transverse rolls (18) defining a possible first assembly (19) of rolls, a second assembly (28) of rolls and a third assembly (29) of rolls. The casting chamber (11) has an enlargement provided by a central curve defined by a first equivalent radius R, the central curve at the inlet (16) of the casting chamber (11) being defined by the specific first equivalent radius R' and by a width L of at least 500 mm. with a value of the lateral half-enlargement A between 30 mm. and 90 mm., the casting chamber (11) comprising within its length a first segment (26) and a terminal segment (27), a zone of curved connection (23) being included between the first segment (26) and the terminal segment (27), the terminal segment (27) being equal to between about one quarter and one sixth of the overall length of the crystallizer (10), the terminal segment (27) comprising a first terminal portion (27') defined by the respective curved connection zone (23) and a second terminal portion (27"), the second terminal portion (27") having a constant section of its passage with a lateral half-enlargement B having a value between 1 mm. and 12.5 mm. and defined by a central curve with a specific first equivalent radius R".

28 Claims, 2 Drawing Sheets

METHOD OF AND MOLD FOR THE CONTINUOUS CASTING OF THIN SLABS

BACKGROUND OF THE INVENTION

This invention concerns a mold, whether straight or curved, for the continuous casting of thin slabs. The invention can also be applied to molds for medium slabs.

The mold according to this invention is employed to produce thin slabs, and also advantageously medium slabs, suitable for subsequent rolling for the production of sheet or strip (coils).

The mold according to the invention has the purpose of producing slabs from 800 mm. to 3000 mm., or more, wide with thicknesses which may vary from 30 mm. to 90 mm. in the case of thin slabs and from 90 mm. to 150 mm. in the case of medium slabs.

Molds for the continuous casting of thin slabs are disclosed in the state of the art.

US-A-2,564,723 teaches the inclusion of a casting chamber in an intermediate position in the wide sides of the mold; this casting chamber has a surface conformed as a rhombus and not only enables a reserve of liquid metal to be formed which can thus feed the zone of the narrow sides but also enables the discharge nozzle of the tundish to be inserted so as to discharge liquid metal below the meniscus.

Next, it is necessary in the field of the rolling of sheet or strip that rolling campaigns should be carried out with different widths so as to meet market requirements.

US-A-4,134,441 therefore teaches the displacement of the narrow sides of the mold during the casting process so as to produce programmed widths of thin slabs.

SU-A-143.215 and JP-A-51-112730 disclose casting chambers with a curved peripheral development so as to prevent lengthwise cracks due to the sliding of the solidification skin, which has to take up substantial developments to arrive at the outlet section.

EP-C-149.734 includes the teachings of all these documents of the prior art and sets them forth in a coordinated manner so as to arrive at the same identical purposes.

All these documents of the prior art and also the present existing state of the art regarding thin slabs, namely slabs with a thickness of about an average value of 50 to 60 mm., provide for the casting chamber to extend vertically by about a quarter to a third, or by a maximum of a half, of the length of the mold. This condition, however, retains considerable problems of stress and strain on the skin while leaving the casting chamber and adapting itself to the surrounding walls.

So as to lessen these problems partly, very long and gently curved connecting portions have been provided in the zone of the change of direction, but these proposed embodiments do not obviate the existence of great metallurgical problems which reduce the withdrawal speed and the quality of the resulting product owing to lateral thrusts against the skin, the danger of removal of the skin and the turbulence caused by the modest dimensions of the casting chamber.

JP-A-51-112730, which concerns a mold to produce medium slabs for sheet and strip, provides for the casting chamber to be reduced progressively along practically the whole length of the mold so that the slab at the outlet of the mold has the desired nominal measurements with perfectly straight sides; but this proposal too, although favourable in itself, does not overcome all the problems of output and surface quality of the thin slab, for the quality is not always excellent with every type of steel thus cast. Moreover, the quality of the slab thus produced shows unacceptable quality defects sometimes during the rolling step.

DE-A-2.034.762 discloses a mold with a casting chamber with a through development and the pre-rolling of the enlargements produced in the slab leaving the mold so as to make the slab flat by the time it reaches the end of the discharge roller conveyor.

This document provides for through casting chambers with unchanging dimensions, but these chambers create problems of shrinkage and surface continuity of the skin.

WO-A-89/12516 offers two solutions substantially, of which the first, already contained in EP-A-230886, discloses a chamber with a rectangular plan and with its sides tapered to reach the normal section of the slab at an intermediate position in the length of the crystallizer; this solution in fact includes the same drawbacks, although partly reduced, as those contained also in the teaching of US-A-2,564,723.

The second solution provides for a through casting chamber having a constant width and a taper such that the sides at the center line of the casting chamber reach the dimensions of the slab outside the mold. This second solution includes a long and important pre-rolling process immediately downstream of the mold so as to reduce gradually the convex section. This second solution does not enable a smooth enough skin free of cracks to be produced nor, above all, the present necessary casting speeds to be reached.

Furthermore, this second solution makes difficult the alignment between the outlet of the crystallizer and the containing foot means. It also does not allow the start-up of the continuous casting.

Moreover, in the zone of maximum thermal stress for the slab, that is to say, in the zone of transition between cooling by conduction and cooling by convection, there is a component of thrust towards the center of the slab, and this component causes removal of the skin, combined bending and compressive stresses and deformations of the skin with the formation of hollows.

SUMMARY OF THE INVENTION

The present applicants have designed, tested and embodied this invention to overcome the above shortcomings.

According to the invention, the casting chamber, which is formed with an enlargement in the center of at least one of its two wide sides, is made with a complex curve, which consists of a central curve defining the enlargement and of two lateral curves, which are positioned at the sides of the central curve and blend therewith and with the specific wide straight sides.

Each of these curves may be generated by one single radius or by a plurality of radii to form one single polynomial curve.

For practical descriptive purposes, the words "first equivalent radius" shall be used hereinafter to describe the radius generating the central curve or the radius which generates a curve which is most approximate to the central curve.

Instead, the words "equivalent radius of curved connection" shall be used to describe the radius generating the single lateral curves or the radius which generates a curve which is most approximate to the lateral curves.

The central curve and lateral curves alter progressively the value of the respective equivalent radius by increasing it from the top to the bottom of the crystallizer of the mold while the enlargement is reduced.

This equivalent radius remains constant in that segment where the enlargement according to the invention defines a constant section of passage.

This casting chamber stretches to the lower edge of the mold and retains substantially the same width.

The cross-section of the casting chamber is progressively reduced but at the outlet of the mold a lateral half-enlargement remains which measures from 1 to 12.5 mm at each side, thus measuring a total of 2 to 25 mm. of the thickness of the slab.

This lateral half-enlargement varies from about 1 to 9 mm. per side with slabs having a nominal thickness between 30 and 90 mm.

Where the slabs have a nominal thickness between 90 and 150 mm., this half-enlargement is between 6 and 12.5 mm. per side.

This reduction of the cross-section of the casting chamber includes an intermediate curved connection zone which is connected to a terminal segment, which has substantially straight and parallel walls, that is to say, a constant section of passage.

The terminal segment with a constant section of the through casting chamber enables problems of extraction of the head of the slab anchored to the starter bar to be avoided and, according to the invention,must have a constant section value of at least 120–150 mm.

According to the invention the terminal segment has a length equal to about one fourth to one sixth of the overall length of the mold.

This segment with a constant section, which has substantially straight sidewalls, not only enables casting to be started but also assists alignment and reduces the thermal stress of transition.

According to a variant the width of the casting chamber is varied progressively along the length of the mold except in the terminal segment having a constant section of passage. This variation is advantageously divided at the two sides of each enlargement and is defined by an angle $\beta$ between 0° and 20°.

In the example given hereinafter the reduction of the enlargement in the casting chamber is divided equally on the two sides of the enlargement included in each wide side of the crystallizer.

The containing means located at the outlet of the mold perform the task of containing the slab leaving the crystallizer of the mold. These containing means, like the successive rolls, cooperate with an integrated direct cooling system.

These containing means, which may be containing plates or foot rolls or a combination of the two, contain a through passage geometrically the same as the section of the terminal segment of the casting chamber which also defines the outlet of the crystallizer.

Immediately downstream of the containing means are transverse rolls which have the task of the compression, straightening and possibly the soft reduction of the sidewalls of the slab.

According to the invention at least a first assembly of transverse rolls may be included which defines a section of a passage geometrically the same as the section of the terminal segment that also defines the outlet of the crystallizer.

Thereafter other transverse rolls are included which modify progressively the section of the passage until the wide surfaces of the slab on which a successive set of transverse rolls cooperates have been made parallel and straight.

The final action to flatten the surface of the slab is therefore carried out in a progressive manner at the outlet of the mold by the rotating surfaces of the transverse rolls.

The final flattening carried out by those rotating surfaces entails a plurality of advantages. A first advantage is the bringing of the slab to its final shape with a great reduction of the friction and lateral thrusts and therefore of the possibilities of breakage of the skin; this is so inasmuch as the change of direction with relative sliding, which takes place when the skin in a traditional casting chamber has to emerge to be adapted to the final shape, is replaced substantially by a revolving contact that occurs in the case of this invention, which includes a through casting chamber with a terminal segment having a constant section.

A second advantage consists of the closure of the angle $\alpha$ of reduction of the inclined sidewalls of the casting chamber inasmuch as this angle $\alpha$ is eliminated within the mold; the mold itself includes a substantially straight terminal segment which absorbs the lateral thrust due to the angle $\alpha$. This angle $\alpha$ according to the invention is between 1° and 7°, but advantageously between 2° and 4°.

By making the slab leave the crystallizer of the mold with a shape with a constant section, the invention makes possible the avoidance of the presence of mechanical forces which cannot be correctly controlled and which are in any event anomalous in the zone of the maximum thermal stress, that is to say, in the zone of transition between two types of cooling.

The progressive reduction of the angle $\alpha$ defining the reduction of the first segment of the casting chamber lessens substantially the possibility of formation of surface hollows in the skin of the slab being formed.

According to the invention the intermediate connection zone between the first segment and terminal segment of the mold is defined by an intermediate connecting curve, which may be a polynomial curve or a curve generated by one single radius; hereinafter the term "radius of intermediate curved connection rr" shall be used to describe the radius which generates the intermediate connecting curve or the radius which is most approximate to the intermediate connecting curve.

The invention arranges that the lateral curves connecting the central curve to the respective straight lateral segments of the wide sides of the mold should be very long and gentle; in other words the equivalent radius of the curved connection according to the invention is much greater than the first equivalent radius.

The ratio between the equivalent radius of curved connection and the first equivalent radius is between 1.5:1 and 3:1.

This value of the equivalent radius of curved connection, owing to its size and conformation, prevents combined bending and compressive stresses forming on the skin with unfavourable effects such as slipping of the skin and the formation of hollows.

As said earlier, the task of compressing and straightening the enlarged part of the slab leaving the crystallizer is carried out by one or more transverse rolls positioned in sequence at the outlet of the mold.

Where the task of reducing the enlargement and straightening the wide sides of the slab is performed by a plurality of transverse rolls, the upstream transverse rolls may have circumferential hollowed shapes which are progressively reduced until cylindrical transverse rolls are reached for the progressive flattening of the surface of the slab.

The transverse rolls which do not carry out the surface straightening action but perform the containing and possible soft reduction action on the wide sides of the slab and which therefore do not have a hollowed circumferential shape may have, or at least some of them may have, a convex development towards the center of their sides (barrel-shaped).

With the embodiment according to the invention the casting chamber is therefore longitudinally a through chamber, and the progressive reduction of the perimetric development of the various sections in the first segment of the casting chamber is such as will compensate, or at least partly adapt itself to, the natural shrinkage of the skin, thus avoiding contraction of, and combined bending and compressive stresses on, the skin.

The greater size of the casting chamber is such as to enable the molten metal to be discharged without excessive turbulence or washing of the sidewalls but with greater rates of flow of the molten metal and with achievement of higher output.

Moreover, the ability to contain a greater quantity of lubricating powder and the greater hot surface in contact with that lubricating powder make available a greater quantity of molten powder, which cooperates between the skin and the sidewalls of the crystallizer.

Furthermore, it is possible with this invention to carry out at the outlet in a controlled and continuous manner the so-called "soft reduction" without loading the narrow sides of the mold with combined bending and compressive stresses.

BRIEF DESCRIPTION OF THE DRAWINGS

The attached figures, which are given as a non-restrictive example, show the following.

DETAILED DESCRIPTION OF THE PREFERRED EMBODIMENTS

Figure 2:
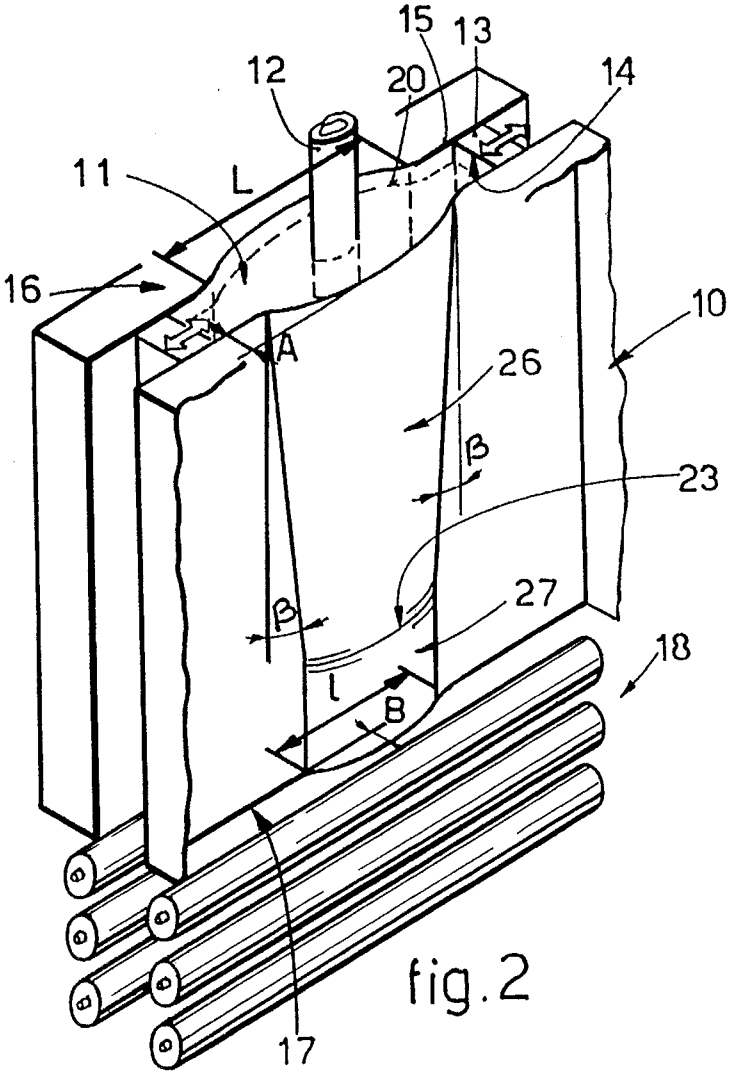
FIG. 2 shows a linear mold with a casting chamber having a decreasing width.

The figures include drawings of molds 10 and show only what is essential and, in particular, the profile of the section of the crystallizer of the mold 10.

The crystallizer may consist of copper, a copper alloy or another material and includes the usual chambers with a circulation of cooling water.

The mold 10 is subject, also in a known manner, to to-and-fro longitudinal movements, that is to say, movements substantially along its axis of the sliding of molten metal and therefore of the slab, and comprises a crystallizer with wide sides 15 and narrow sides 14. The narrow sides 14 are defined by movable sidewalls 13 which, by being displaced, determine the width of the outgoing slab.

A casting chamber 11 is provided at an intermediate position between the wide sides 15 and lodges a discharge nozzle 12 of a tundish, which delivers molten metal advantageously towards the movable sidewalls 13 and downwards below a meniscus 20.

The casting chamber 11 has a median plane M; which is perpendicular to the wide sides 15 and is longitudinal to the crystallizer.

Containing means 24 are located at an outlet 17 of the mold 10 and in this example are shown as being plates followed by transverse rolls 18, which act against the wide sides 15 of the slab.

The containing means 24 define a section of a passage, this section being substantially the same as that of the outlet of a terminal segment 27 of the mold 10, and may be equipped with means for resilient adaptation to the surface of the slab passing through.

Rolls may also be included which act against the narrow sides 14 of the slab, or else these rolls may be replaced by containing plates or other known means. The whole assembly cooperates with cooling means 25 of a known type.

The transverse rolls 18 may be divided longitudinally into two or more segments which cooperate with intermediate bench supports.

The transverse rolls 18 in this example (FIGS. 1 and 3) comprise a first assembly 19 of rolls having their profile coordinated with the outlet section of the crystallizer; this profile defines a section of a passage equal to the outlet section of the terminal segment 27 of the mold 10.

The transverse rolls 18 comprise next a second assembly 28 of rolls, the profiles of which are modified progressively so as to cause the section of the slab, which emerges with enlargements of its wide sides 15 determined by the outlet section of the terminal segment 27 of the mold 10, to have its wide sides 15 parallel and without enlargements so that the slab can cooperate with a third assembly 29 of cylindrical or possibly convex rolls.

As said above, the containing means 24 and rolls 18 cooperate with direct cooling means 25.

Figure 3:
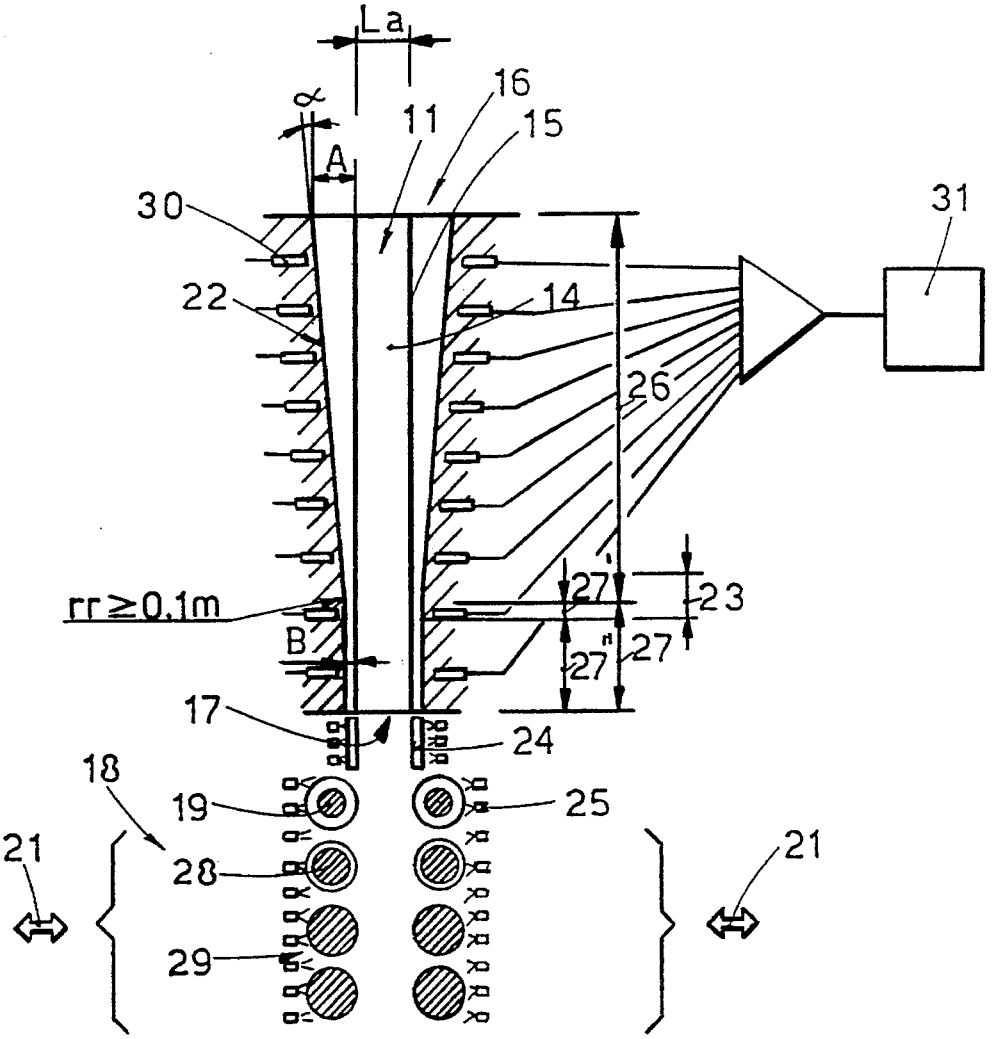
FIG. 3 shows a lengthwise section of a mold with a through casting chamber that decreases and with a final constant segment according to the invention.

According to the invention, as shown in FIG. 3, the cross-section of the casting chamber 11 includes a first segment 26, which is reduced progressively and constantly and is followed by a terminal segment 27, an intermediate curved connection zone 23 being comprised. The intermediate curved connection zone 23 defined by an intermediate connecting curve has the purpose of preventing problems of slipping of the skin.

The casting chamber 11 has at its inlet a width L defined by the central curve defining the enlargement and also a depth defined by a nominal width La of the movable sidewalls 13, to which should be added the enlargement, which at the inlet 16 has a value 2A; A in the drawings is the value of the lateral half-enlargement of the inlet 16 of the casting chamber 11 in one wall of the crystallizer and is measured substantially along the medium plane M. The central curve of this lateral half-enlargement, which at the inlet 16 has a value A, is defined by specific first equivalent radii R.

This first equivalent radius R takes on a value indicated with R' at the inlet 16.

In the first segment 26 the enlargement of the casting chamber 11 is reduced progressively with a resulting constant increase of the first equivalent radius R.

According to the invention the value of L is at least about 500 mm. and may reach much higher values in relation to a greater width of the wide sides 15.

The value of A according to the invention may vary between 30 and 90 mm.; this enlargement value, in fact, is a function of the value of the nominal width La of the movable sidewalls 13 and is a function of other metallurgical factors.

The terminal segment 27 occupies about one quarter to one sixth of the overall length of the crystallizer and comprises a first terminal portion 27' defined by the respective curved connection zone 23 and a second terminal portion 27" with substantially straight and parallel sidewalls and a constant section of its passage.

In other words the section of the passage in the second terminal portion 27", which begins immediately downstream of the curved connection provided in the zone 23, is constant, and according to the invention this second terminal portion 27" with a constant section has to have a value of at least 120–150 mm.

The curved connection zone 23 is defined by an intermediate connecting curve, which may be a polynomial curve or be a curve generated by one single radius.

To facilitate the description hereinafter, the term "radius of intermediate curved connection rr" shall be used; this radius of intermediate curved connection rr, defines the generating radius of the intermediate connecting curve or the radius which generates the curve that is most approximate to the intermediate connecting curve.

According to the invention this radius of intermediate curved connection rr at the plane M takes on a value not less than 0.1 meters.

Figure 1:
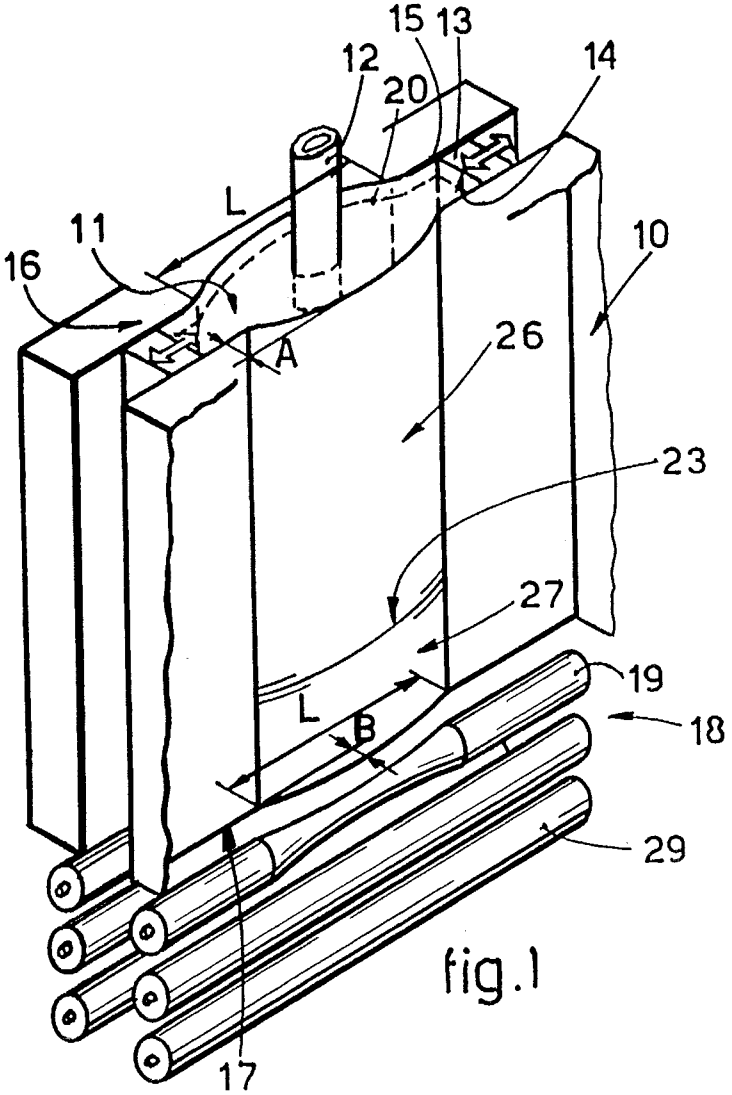
FIG. 1 shows a linear mold with a casting chamber having a substantially constant width.

In the second terminal portion 27" and therefore at the outlet 17 too the width of the casting chamber 11, according to the embodiment of FIG. 1, will always be about L, but the relative lateral half-enlargement has changed from A to B, with B having a value between 1 and 12.5 mm.

In the casting chamber 11 the first equivalent radius R has changed progressively from the specific first equivalent radius R' at the inlet 16 to the specific first equivalent radius R" at the outlet 17, having remained constant along the whole second terminal portion 27".

Figure 4:
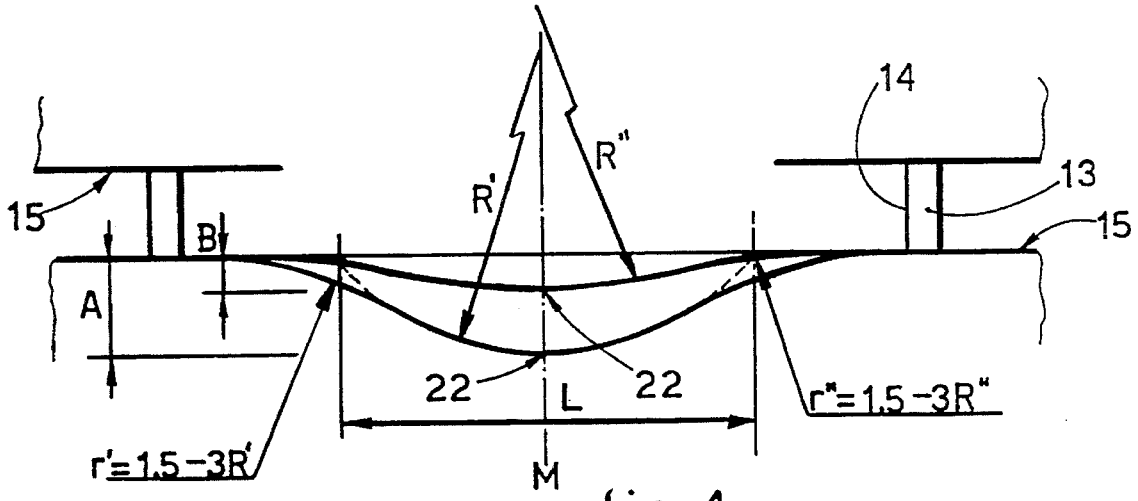
FIG. 4 shows a type of enlargement and rounded connection portion of the casting chamber according to the invention.

As shown in FIG. 4, the central curve of the casting chamber 11 blends at its sides into the straight wide sides with lateral curves of which the equivalent radius of curved connection r is 1.5 to 3 times the first equivalent radius R defining substantially the central curve of the enlargement of the casting chamber 11 at that resulting longitudinal point.

In other words the equivalent radius of curved connection r changes from the specific equivalent radius of curved connection at the inlet 16 r'=1.5 to 3 times R' to the specific equivalent radius of curved connection r"=1.5 to 3 times R" in the second terminal portion 27" and at the outlet 17.

The solution of providing a through casting chamber 11 along the whole length of the crystallizer, with a first segment 26 having a progressive reduction of its section and extending along three quarters to five sixths of the length, makes it possible to have an angle α which is defined along the reference line 22 of the plane of the center line M and which is closed within the crystallizer, thus allowing time for the tensions to be discharged in the second terminal portion 27".

According to the invention the angle α has a value between 1° and 7°, but advantageously between 2° and 4°. The inclusion of the angle α and its behavior obviate problems linked to the changes of direction of the skin.

The fact that the invention includes a change of direction in the curved connection zone 23 does not cause the formation of surface hollows, this being so owing to the modest value of α and the inclusion of the intermediate connection curve defined by the radius of intermediate curved connection rr.

According to the variant of FIG. 2 the first segment 26 of the casting chamber 11 is inwardly tapered progressively at each wide side 15 by an angle β and this is altered from a value L to a value 1 and from a value A to a value B, thereafter keeping the values L and B in the second terminal portion 27" downstream of the curved connection zone 23.

According to the invention the value β is between 0° and 20°.

According to another variant of the invention the enlargement of the casting chamber 11 is made wholly and only in one wide side 15 alone of the mold 10, so that the other wide side 15 is flat.

According to the invention, when casting starts, the second assembly 28 of rolls and the third assembly 29 of rolls are opened apart in the directions 21 to let the head of the starter bar pass through and be positioned in the terminal segment 27.

When casting has already begun, the head of the starter bar is withdrawn from the terminal segment 27 and then from the containing means 24 and first assembly of rolls 19, and as the starter bar passes the rolls 18 of the second and third assemblies 28–29, those rolls 18 are brought towards each other to act against and pre-roll the enlargement of the slab.

According to the invention the crystallizer may include differentiated cooling zones having, for instance, a lower thermal conductivity in the zone of the meniscus 20.

According to the invention the mold 10 is equipped with temperature sensors 30 to monitor the thermal map. In this case these temperature sensors 30 are associated with a device 31 which controls and manages the continuous casting plant and which comprises data bank comparison means and governing means to manage the continuous casting process and the cooling, whether primary or secondary cooling.

I claim:

1. A mold for the continuous casting of slabs, comprising:

a pair of spaced, opposed wide sidewalls; and a pair of spaced, opposed narrow sidewalls, said narrow sidewalls being movable between said wide sidewalls to adjust a width of a slab cast by said mold, said pair of wide sidewalls and said pair of narrow sidewalls defining a crystallizer having a casting chamber having a length extending from an inlet to an outlet;

wherein said casting chamber contains an enlargement extending along said length of said casting chamber from said inlet to said outlet, said enlargement being provided by a curved section of at least one of said pair of wide sidewalls, said curved section having a central curve defined by a first equivalent radius R, the central curve at said inlet being defined by a specific first equivalent radius R', by a width L of at least 500 mm, and by a lateral half-enlargement A between 30 mm and 90 mm, said lateral half-enlargement A being measured along a median plane M extending perpendicular to said wide sidewalls and longitudinal to said crystallizer, said enlargement comprising within its length a first segment beginning at said inlet, a terminal segment extending to said outlet and a zone of curved connection therebetween, said terminal segment being equal to between about one quarter and one sixth of the overall length of the crystallizer, the terminal segment comprising a first terminal portion defined between the curved connecting zone and a second terminal portion which extends to said outlet, the second terminal portion having a constant section with a lateral half-enlargement B measured along said median plane M and having a value between 1 mm and 12.5 mm and being defined by a central curve with a specific first equivalent radius R".

2. A mold as in claim 1, in which the central curve of the enlargement of the casting chamber at the inlet of the terminal segment defines the width L.

3. A mold as in claim 1, in which the enlargement of the casting chamber at the inlet of the terminal segment defines a width l comprised between a value immediately less than L and a value defined by at least one angle of lateral reduction β of at least one side of the enlargement of the casting chamber.

4. A mold as in claim 1, in which the cross-section of the first segment of the casting chamber is reduced progressively down to the zone of curved connection by an angle α measured along the medium plane M, this reduction defining a plurality of first equivalent radii R increasing progressively in the downward direction, the angle α being between 1° and 7°.

5. A mold as in claim 1, in which the central curve of each enlargement of the casting chamber blends by means of lateral curves into straight sides of the respective wide sidewalls outside said enlargement, the conformation of the lateral curves being defined by an equivalent radius r of curved connection, the value of the radius r being between 1.5 and 3 times the value of the corresponding first equivalent radius R.

6. A mold as in claim 1, in which the first equivalent radius R defining the central curve of the casting chamber is a true radius.

7. A mold as in claim 1, in which the first equivalent radius R characteristic of the central curve of the casting chamber defines a polynomial curve.

8. A mold as in claim 5, in which the equivalent radius of curved connection r defining at least one lateral curve of the casting chamber is a true radius.

9. A mold as in claim 5, in which the equivalent radius of curved connection r characteristic of at least one lateral curve of the casting chamber defines a polynomial curve.

10. A mold as in claim 1, in which the zone of curved connection between the first segment and the terminal segment of the casting chamber is defined by a curve of intermediate connection generated by a radius of intermediate curved connection rr of which the value is at least 0.1 meters.

11. A mold as in claim 1, in which the enlargement extends along the length of one wide sidewall of the casting chamber.

12. A mold as in claim 1, further comprising temperature sensors defining a thermal map which are associated with a device that controls and manages the casting, the device comprising a data bank and a governor to govern the operation of the continuous casting of slabs and primary and secondary cooling.

13. A mold as in claim 1, wherein said wide sidewalls are spaced from one another by a distance sufficient to cast thin slabs having a thickness from 30 mm to 90 mm.

14. A mold a in claim 13, wherein said lateral half-enlargement B has a value from 1 to 9 mm.

15. A mold as in claim 1, wherein said wide sidewalls are spaced from one another by a distance sufficient to cast thin slabs having a thickness from 90 mm to 150 mm.

16. A mold a in claim 15, wherein said lateral half-enlargement B has a value from 6 to 12.5 mm.

17. A mold as in claim 1, wherein said enlargement extends along the length of both of said pair of wide sidewalls.

18. A combination, comprising the mold of claim 1, and, immediately downstream thereof, containing means provided adjacent said outlet of said casting chamber for containing the slab, exiting therefrom; and, immediately downstream of said containing means, a plurality of assemblies of rolls, each assembly extending perpendicular to said medium plane M, rolls of said assemblies of rolls having profiles modified progressively from one assembly to a downstream assembly such that the slab, which exits from said outlet with a longitudinally extending enlargement corresponding to said terminal section of said casting chamber, is progressively rolled to have parallel wide sides.

19. A combination as in claim 18, wherein said containing means comprises spaced plates defining a passage having a cross-section substantially the same as that of said terminal segment of said casting chamber of said mold.

20. A combination as in claim 18, wherein rolls of an upstream-most assembly of said plurality of assemblies of rolls have profiles coordinated with the outlet section of said casting chamber.

21. A combination as in claim 20, wherein rolls of a downstream-most assembly of said plurality of assemblies of rolls have a cylindrical profile.

22. A combination as in claim 20, wherein rolls of a downstream-most assembly of said plurality of assemblies of rolls have a convex profile.

23. A combination as in claim 18, wherein the containing means have a first working position for containing the slab and a second opened-apart position which allow passage of a head of a starter bar.

24. A combination as in claim 18, wherein an upstream-most assembly of said plurality of assemblies of rolls has a first working position for rolling the slab and a second opened-apart position which allows passage of a head of a starter bar.

25. A combination as in claim 24, wherein a second assembly of said plurality of assemblies of rolls positioned downstream of said upstream-most assembly has a first working position for rolling the slab and a second opened-apart position which allows passage of the head of the starter bar.

26. A combination as in claim 25, wherein a third assembly of said plurality of assemblies of rolls positioned downstream of said second assembly has a first working position for rolling the slab and a second opened-apart position which allows passage of the head of the starter bar.

27. A combination as in claim 18, wherein at least downstream ones of said plurality of assemblies of rolls have a first working position in which the rolls of each assembly are spaced at a first distance so as to act against and pre-roll said longitudinally extending enlargement of the slab, and a second open position in which the rolls of each assembly are spaced apart at a second distance greater than the first distance so as to enable a starter bar to pass therethrough.

28. A method to cast slabs using the combination of claim 27, the method comprising, opening the rolls of said downstream ones of said plurality of assemblies of rolls to said second open position; introducing the head of a starter bar through said casting chamber; withdrawing the starter bar from the casting chamber and past said plurality of assemblies of rolls; and progressively closing the rolls of said downstream ones of said plurality of assemblies of rolls to said first working position against the slab as soon as the head of the starter bar being withdrawn has passed them in the step of withdrawal of the starter bar.

* * * * *